US006425329B1

(12) United States Patent
Crystal et al.

(10) Patent No.: US 6,425,329 B1
(45) Date of Patent: Jul. 30, 2002

(54) CONVERTIBLE MEDIA DRYER FOR A LARGE FORMAT INK JET PRINT ENGINE

(75) Inventors: Kevin R. Crystal, Chanhassan; Richard Joseph Bigaouette, Chaska, both of MN (US)

(73) Assignee: MacDermid Acumen, Inc., Waterbury, CT (US)

( * ) Notice: Subject to any disclaimer, the term of this patent is extended or adjusted under 35 U.S.C. 154(b) by 0 days.

(21) Appl. No.: 09/947,029

(22) Filed: Sep. 5, 2001

Related U.S. Application Data

(63) Continuation of application No. 09/251,531, filed on Feb. 17, 1999, now Pat. No. 6,308,626.

(51) Int. Cl.[7] ..... B41F 23/04
(52) U.S. Cl. ..... 101/424.1; 101/487
(58) Field of Search ..... 101/424.1, 487, 101/488; 347/102, 187, 47; 219/216, 201

(56) References Cited

U.S. PATENT DOCUMENTS

| | | | | | |
|---|---|---|---|---|---|
| 4,425,719 | A | * | 1/1984 | Klein et al. | 34/156 |
| 4,989,348 | A | * | 2/1991 | Vits | 34/155 |
| 5,136,938 | A | | 8/1992 | Pellegrina | 101/424.1 |
| 5,207,008 | A | * | 5/1993 | Wimberger et al. | 34/23 |
| 5,262,872 | A | | 11/1993 | Yoshimura et al. | 358/296 |
| 5,579,590 | A | * | 12/1996 | Seidl et al. | 34/559 |
| 5,621,983 | A | * | 4/1997 | Lundemann et al. | 34/641 |
| 5,647,144 | A | * | 7/1997 | Bria et al. | 34/414 |
| 5,826,152 | A | | 10/1998 | Suzuki et al. | 399/330 |
| 5,864,352 | A | | 1/1999 | Aoki et al. | 347/102 |
| 6,293,196 | B1 | * | 9/2001 | DeMoore et al. | 101/424.1 |

FOREIGN PATENT DOCUMENTS

| | | |
|---|---|---|
| EP | 423820 | 4/1991 |
| JP | 254156537 | 12/1979 |
| JP | 358 081168 | 4/1991 |

* cited by examiner

*Primary Examiner*—Andrew H. Hirshfeld
*Assistant Examiner*—Anthony H. Nguyen
(74) *Attorney, Agent, or Firm*—Carmody & Torrance LLP

(57) ABSTRACT

The apparatus of the present invention increases the operating envelope for large format thermal ink jet printing via a directed fluid flow from specially-designed orifices which promote fluid flow on a printed surface adjacent a printing zone in a large format ink jet printer where in addition to the optimized fluid flow one or more heating elements are inserted directly into the fluid flow to thereby promote drying of said printed surface. In one embodiment, a single dual-duct plennum spans the width of a roll-fed large format ink jet print engine and a first duct distributes heated air downward (in the direction of media web movement) and a second duct evacuates a printing space so that any potentially harmful ink vapors or other air-borne contaminant is appropriately fluidly coupled to either a remote exhaust vent or vapor capture vessel.

12 Claims, 5 Drawing Sheets

CONVERTIBLE MEDIA DRYER FOR A LARGE FORMAT INK JET PRINT ENGINE

This application is a continuation of application Ser. No. 09/251,531, filed Feb. 17, 1999, now U.S. Pat. No. 6,308, 626.

FIELD OF THE INVENTION

The present invention relates generally to the field of printing. In particular, an apparatus for expelling a warmed fluid curtain over a freshly printed surface of a media adjacent a printing zone through apertures designed to create a fluid flow at the printed surface adequate for promoting drying of the entire freshly-printed surface. In combination with said fluid flow a separate fluid recovery pathway evacuates ink vapors, dust, and particulates created during printing so they can be appropriately contained or vented.

BACKGROUND OF THE INVENTION

The present invention addresses a need in the art to reliably and safely increase throughput of large format ink jet print engines. One constraint impeding the ability to increase printing speed (typically expressed as a square foot/hour measurement) of large format ink jet print engines is ink drying characteristics and the amount of ink expelled upon the media (or "ink coverage" typically expressed as a percentage of coverage by a given color of ink). The physical make up of the printing surface, any coatings present on the printing substrate, the type of ink applied, and whether any post-printing drying or vapor recovery treatment(s) are applied all contribute to a reliable and safe rate of throughput for large format print engines.

Ambient conditions affect the ability to print high quality prints at an efficient rate of throughput. In fact, a rise of relative humidity (RH) of just a few percent can inhibit ink drying in at least two ways. First, if the printing media is not insulated from the rising humidity, the media itself can acquire a moisture content that will in effect displace the ink that is later applied, with the result that the media simply cannot absorb as much ink as when it is "dry." Second, if the ambient atmospheric conditions become saturated, the ability of the ink to dry (or be absorbed into the ambient air) is inhibited and thus, printed output will dry only slowly. Particularly with roll-based media printed in quantity (or banner prints), if printed media is not fully dry after printing the print might transfer to the back of an adjacent portion of media, or smudge, when the printing substrate is rolled prior to cutting into individual images.

In the prior art, a variety of forced air dryers have been employed to increase the evaporation and drying of ink printed onto a section of media. In addition, some prior art approaches link one or more atmospheric sensors to a printing control unit to slow printing operations when ambient conditions do not promote drying. Also, some prior art techniques have used a "media loop" (in conjunction with a proximity sensor disposed to sense the presence of said media loop) wherein the just-printed media passively hangs prior to being rolled to thereby increase the drying time, or exposure of the media to ambient drying conditions.

When the type of inks used contain agents to promote drying, or when the ink itself releases vapors and possibly harmful air-borne material, a dedicated system for removing said vapors or possibly harmful air-borne material has been implemented in large-scale printing systems—but to the inventors' knowledge no such system has even been combined into a single unit, nor adapted to operate in conjunction with a single large format thermal ink jet print engine.

The present invention thus finds utility over a variety of printing platforms that operate to simply expel air in the vicinity of printed output and also offers vapor recovery/evacuation from a common assembly so that thermal ink jet printing can be successfully practiced over a large variety of atmospheric conditions and in conjunction with a large variety of solvent-based inks compositions.

SUMMARY OF THE INVENTION

The apparatus of the present invention increases the operating envelope for large format thermal ink jet printing via a directed fluid flow from specially-designed orifices which promote an approximately equal fluid flow over an entire printed surface adjacent a printing zone in a large format ink jet printer where in addition to the optimized fluid flow one or more heating elements are inserted directly into the fluid flow to thereby promote drying of said printed surface. In the exemplary embodiment, dual fans each supply a plenum chamber with a constant supply of forced air that immediately interacts with heated metal coils of an in-line heater unit which raises the temperature of the air approximately 20 degrees Fahrenheit. As a result of this increase in air temperature the air is able to carry far more moisture than if the air were at ambient conditions. As an example, if the air were to rise 10 degrees Celsius traditional calculations indicate that about double the amount of moisture can be absorbed into the air. In the embodiment just described, each fan is rated at 30 cubic feet per minute.

In one embodiment, a single dual-duct plennum spans the width of a roll-fed large s format ink jet print engine and a first duct distributes heated air downward (in the direction of media web movement) and a second duct evacuates a printing space so that any potentially harmful ink vapors or other air-borne contaminant is appropriately fluidly coupled to either a remote exhaust vent or vapor capture vessel.

The following figures are not drawn to scale and only detail a few representative embodiments of the present invention, more embodiments and equivalents of the representative embodiments depicted herein are easily ascertainable by persons of skill in the digital imaging arts.

DESCRIPTION OF PREFERRED EMBODIMENT

Figure 1:
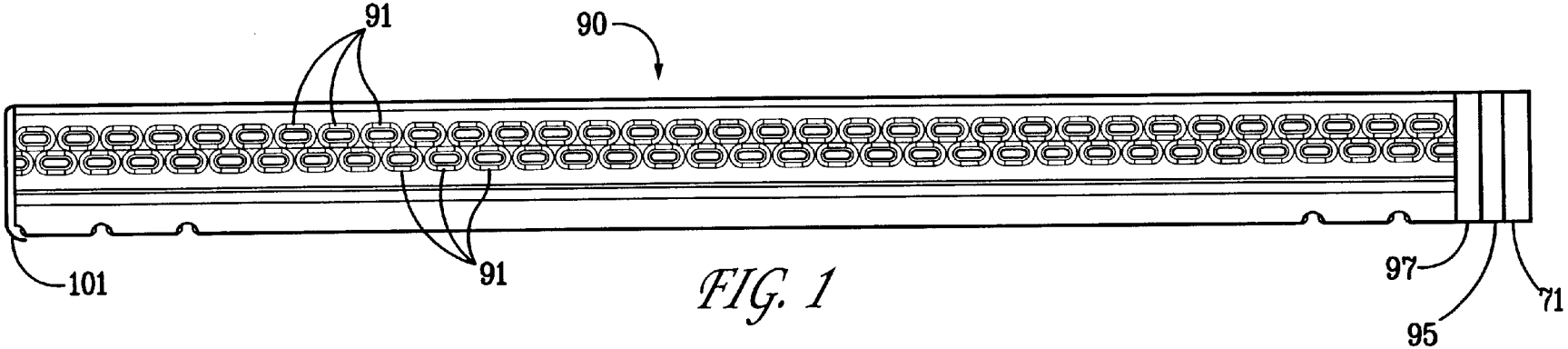
FIG. 1 is a plan view of a plennum member having a plurality of ports on a lower side, a flow promoting transition plennum section, a heater, and a fan as taught in one embodiment of the present invention.

The present invention is first described with reference FIG. 1, which is a plan view of a plennum member 90 having a plurality of ports 91 on a lower side a flow promoting transition plennum section 97, a heater, and a 71 fan as taught in one embodiment of the present invention. A single speed fan capable of moving approximately thirty (30) cubic feet per minute adequately performs the functions required of the fan 71 depicted in FIG. 1. The fan 71 and a heater element 93, preferably fabricated of a chromium alloy or other suitable material, is slaved to a printing control indicator from remote control electronics (not shown) of print engine so that the fan and heater operate only during printing operations of said print engine thereby extending the life of the components of fan 71 and heater element 93 and reducing operating costs of print engine. In a particularly preferred embodiment, a flow-promoting transition section 97 is designed to most efficiently utilize the air flow produced by the fan 71 by a subtle coiling of a flow path within the section 97 (see FIG. 8 and FIG. 9 for perspective views of section 97). As depicted in FIG. 1 (and FIG. 3), the ports 91 are preferably arranged in at least two overlapping sets of elongate ports. When energized during printing operations of print engine 100, the fan 71 provides a rotating air stream through heater box 95 (and over heater elements 93) and then through the section 97 and into the main plennum member 90. As the air stream exits the section 97 oftentimes the ports 91 adjacent section 97 failed to produce adequately air flow in relation to other ports 91 of plennum member 90. The inventor thus opted for a substantially flat section on the side of the plennum member 90 shared with the ports 91 to promote fluid flow at said first set of ports 91 adjacent to section 97. This flat section is believed to substantially increase fluid flow at the ports 91 adjacent section 97 so that more or less even fluid delivery occurs among all ports 91. Thus, when energized during printing, a relatively consistent air flow is dispersed from the ports 91 onto the freshly printed printing substrate. In a preferred embodiment, a printing zone (not shown) available on the upper surface of a platen member (not shown) is between thirty-six and seventy-two inches (36"–72") in length. The printing zone of the platen member is preferably disposed close enough to plennum member 90 so that the plennum member 90 can efficiently dispense a chaotic heated air flow over freshly printed printing substrate(s) to thereby greatly enhance drying thereof at the earliest possible opportunity.

Figure 2:
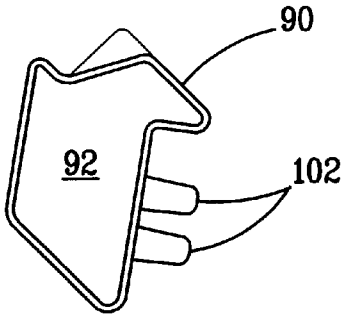
FIG. 2 is cross sectional view of the inventive dryer plennum structure of the present invention during manufacture of said structure as a unitary rotary-molded piece prior to removal of the end portions of a set of hollow bosses, which then become the ports of the plennum assembly.

Referring now to FIG. 2, which is cross-sectional view of the inventive dryer plennum 90 structure of the present invention during manufacture of said structure as a unitary rotary-molded piece showing the enclosed interior plennum space 92 therein prior to removal of the end portions 102 of a set of hollow bosses, which then become the ports 91 of the plennum assembly 90. This view also illustrates the structural integrity designed into the plennum member 90 (not the creases and angled sides which promote rigidity of the plenum 90) and the rotary molding technique assures all interior air stream-conveying spaces (92) navigates an inherently smooth, laminar flow-inducing fluid pathway. The manner of manufacture of the plennum member 90 provides benefits in terms of mold costs, fabrication costs and time, and weight reduction over typically used materials.

Figure 3:
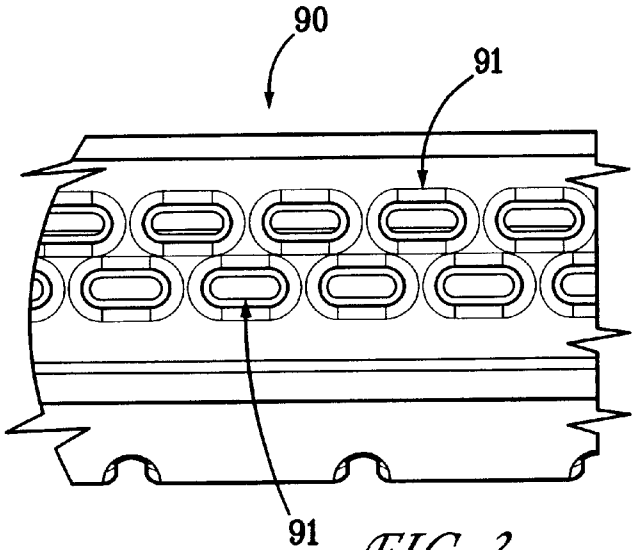
FIG. 3 is an enlarged view of the ports depicted in FIG. 1 illustrating the overlapping orientation of the ports in one preferred embodiment of the present invention.

Referring now to FIG. 3, which is an enlarged view of the ports 91 depicted in FIG. 1 illustrating the overlapping orientation of the ports 91 in one preferred embodiment of the present invention. The ports 91 are designed to promote a constant, even, heated air flow via the interaction of individual air streams emanating from each individual port 91 in the vicinity of a given portion of freshly printed printing substrate. Ports 91 may of course take other shapes and sizes given the available air flow, distance to the printing substrate, number of interior compartments 92 feeding the ports 91 and so on. Testing has shown that if the air flow is not even over the entire printed surface printing artifacts result. Furthermore, if the air flow from the ports 91 is not adequate to essentially flush the heated, now moistened air away from the freshly printed media, the moistened air can rapidly condense back onto the media causing printing artifacts. Thus the size and shape of the ports 91 can be varied to minimize either of these two causes of printing artifacts and if the interior capacity of the plenum, the heater rating (temperature increases the heater can induce in an airflow, or the fan rating are modified the entire system should be re-calibrated so that the criteria noted above are met.

Figure 4:
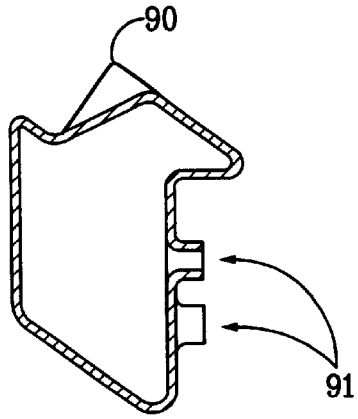
FIG. 4 is cross sectional view of the inventive dryer plennum structure of the present invention during manufacture of said structure as a unitary rotary-molded piece following removal of the end portions of a set of hollow bosses, which are now operable as ports of the plennum assembly.

Referring now to FIG. 4, which is a cross sectional view of the inventive dryer plennum structure 90 of the present invention during manufacture of said structure 90 as a unitary rotary-molded piece following removal of the end portions of a set of hollow bosses, which are now operable as ports of the plennum assembly. This view is similar to the view depicted in FIG. 2 with the exception that the end of the bosses have been eliminated and finished for final assembly.

Figure 5:
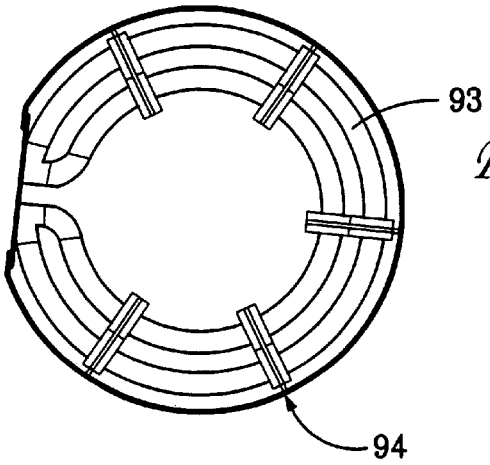
FIG. 5 is an elevational side view of a preferred heating element for use in the heater box fluidly coupled to the fan and plennum in accordance with the present invention.

Referring now to FIG. 5, which is an elevational side view of a preferred heating element 93 for use in the heater box 95 fluidly coupled to the fan 71 and plennum 90 in accordance with the present invention. The heater element 93 is preferably constructed of chromium alloy wire coil material, as is well known for its strength and durability, although other suitable materials may be used in lieu of such known materials provided they possess similar properties. The heater element 93 can be dynamically controlled but in the preferred embodiment, for simplicity the heater element 93 contains a simple threshold cut-off circuit (not shown) which interrupts power to the element 93 once a preset temperature is reached. This power interrupt is not part of the instant invention but is preferred for the inherent measure of safety such an interrupt provides when practicing the present invention.

Figure 6:
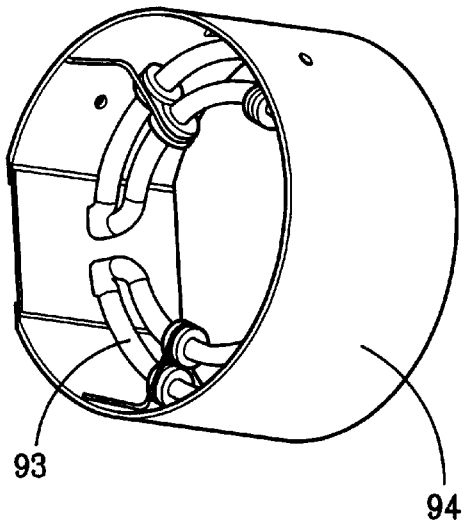
FIG. 6 is a perspective view of a of a preferred heating element coupled to a heating housing/shield for use in the heater box fluidly coupled to the fan and plennum in accordance with the present invention.

Referring now to FIG. 6, which is a perspective view of a of a preferred heating element coupled to a heating housing/shield for use in the heater box fluidly coupled to the fan and plennum in accordance with the present invention.

Figure 7:
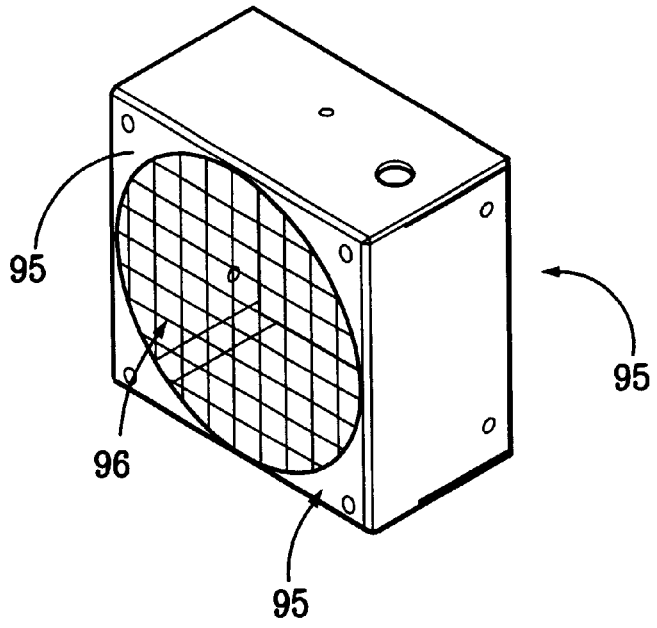
FIG. 7 is a perspective view of a of a preferred heater box for use in accordance with the present invention.

Referring now to FIG. 7, which is a perspective view of a of a preferred heater box for use in accordance with the present invention it can be seen that the heater box is a simple, low cost component sized to complement the interior diameter of the plenum structure 90 and provided with enough electrical power to raise the temperature of ambient air approximately 20 degrees Fahrenheit.

Figure 8:
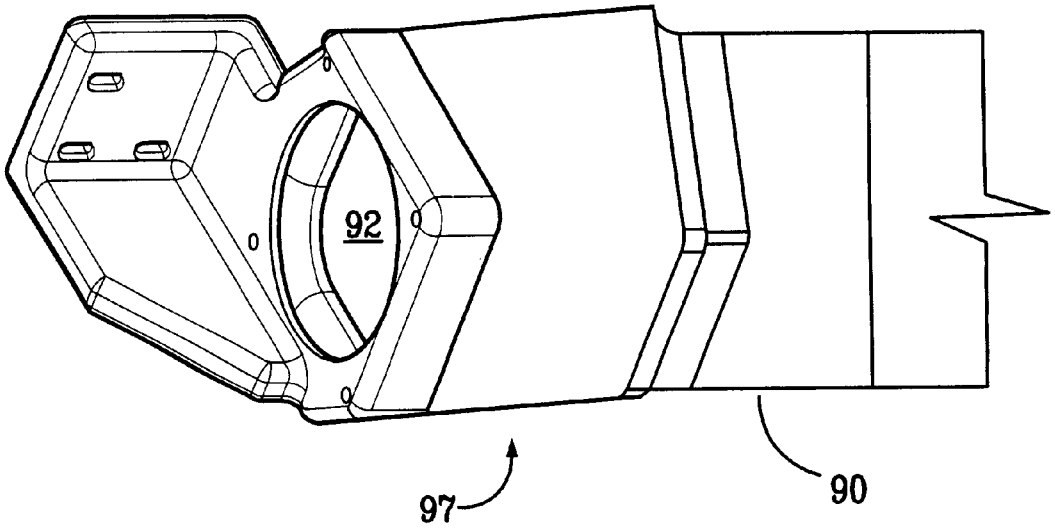
FIG. 8 is a preferred flow-transition plennum fixture which is designed to distribute approximately the same velocity of air flow at every port of the plennum member and in a particularly preferred embodiment includes an flat interior portion to enhance air flow among the ports immediately adjacent to the flow-transition plennum fixture.

Referring now to FIG. 8, which is a preferred flow-transition plennum fixture which is designed to distribute approximately the same velocity of air flow at every port of the plennum member and in a particularly preferred embodiment includes an interior shaped to enhance air flow among the ports adjacent to the flow-transition plennum fixture and can be optimized for a given fan blade direction of rotation (i.e., curvature of said transition sections 97 could be "coiled/wound" in a manner which mimics the flow of air from a rotating fan blade). Although in the economical embodiment of the present invention adequate performance has been observed with fans that rotate the same way, and wherein transition section 97 is not optimized for direction of fan blade rotation. The present preferred design choice reflects the realities of inventory management, ease of field service, and part cost issues combining to produce an effective amount of heating and fluid flow from the ports 91 while at the same time balancing the costs and benefits of using specially designed parts at each end of the plenum assembly 90.

Figure 9:
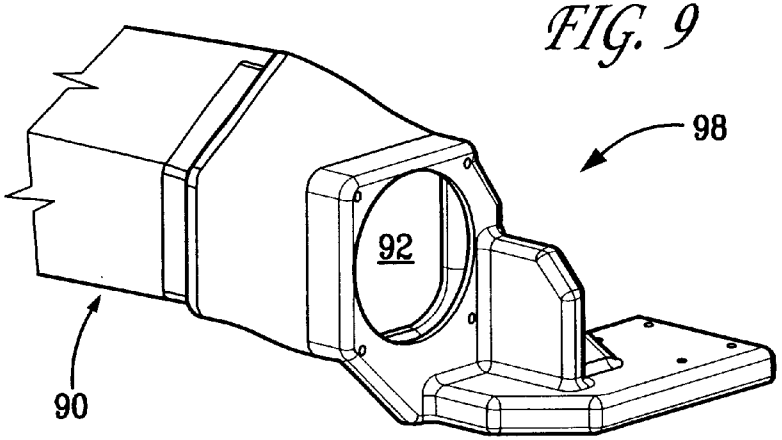
FIG. 9 is a preferred flow-transition plennum fixture which is similar to the flow-transition plennum fixture of FIG. 8 but intended for an opposite side of the plennum member which is designed to distribute approximately the same velocity of air flow at every port of the plennum member and in a particularly preferred embodiment includes an interior strake-obstruction to enhance air flow among the ports adjacent to the flow-transition plennum fixture and is optimized for a given fan blade direction of rotation.

Referring to FIG. 9, which is a preferred flow-transition plennum fixture which is similar to the flow-transition plennum fixture of FIG. 8 but intended for. an opposite side of the plennum member which is designed to distribute approximately the same velocity of air flow at every port of the plennum member and in a particularly preferred embodiment includes an flat interior section adjacent to the ports 91 to enhance air flow among the ports adjacent to the flow-transition plenum section 97. Note again, that transition section 97 and/or fan blade direction of rotation could be optimized as described above.

Figure 10:
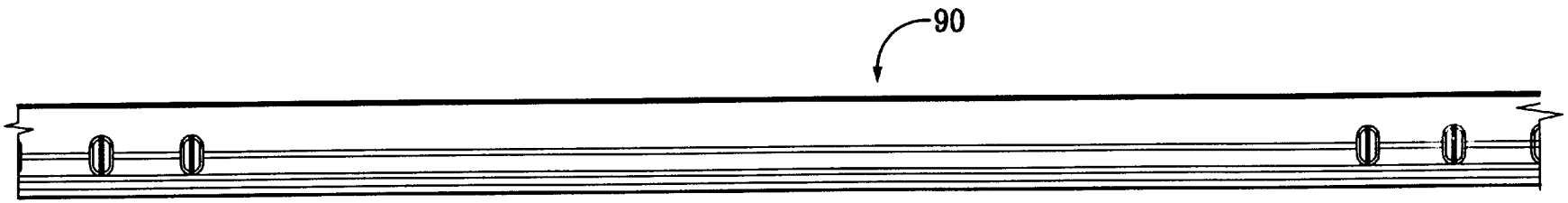
FIG. 10 is a plan view of the upper portion of the plennum member (opposite side of the view depicted in FIG. 1) illustrating how a single rotary-molded dryer plennum member may be fabricated and later finished to suit a particular size print engine build order, in FIG. 10 52", 62", and 72" printing swath (i.e., large format).

Referring to FIG. 10, which is a plan view of the upper portion of the plennum member (opposite side of the view depicted in FIG. 1) illustrating how a single rotary-molded dryer plennum member may be fabricated and later finished to suit a particular size print engine build order, in FIG. 10 52", 62", and 72" printing swath (i.e., large format). The inventors hereof note that reduced costs are realized from a common initial build for all sizes of large format print engine, the ability to inventory a small amount of easily finished (but technically unfinished) plenum members 90, and the rapid turn around time to create a completely finished plenum member of a variety of printer sizes all contributed to the decision to use a single rotary mold for all print engines having dryers designed and produced in accordance with the present invention.

Figure 11A:
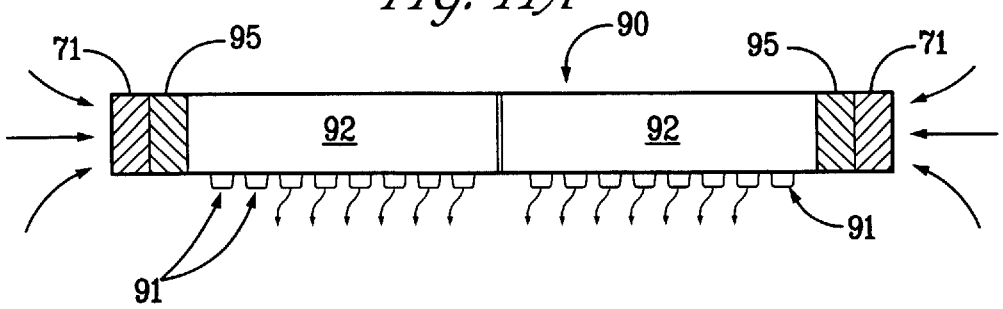
FIGS. 11A–D depicts a variety of embodiments of the present invention; namely, view A, wherein individual fan and heater sets feed a dual chamber plennum member which is equipped with exit ports adjacent a printing zone of a print engine and a freshly printed section of printing media; view B, wherein a single fan and heater feeds a single chamber plennum designed to produce approximately equal air flow at equally-sized or variably-sized ports; view C, wherein the plennum member is divided into at least two axially divided chambers with the chamber nearest the printing zone of a print engine fluidly coupled to an evacuating fan in turn fluidly coupled to a vessel; and view D, wherein a the interior compartments of a dual chamber plennum member can switched via valve member to be alternately fed heated air via a heater and fan assembly operating in one direction or evacuated via an exhaust fan.
Figure 11B:
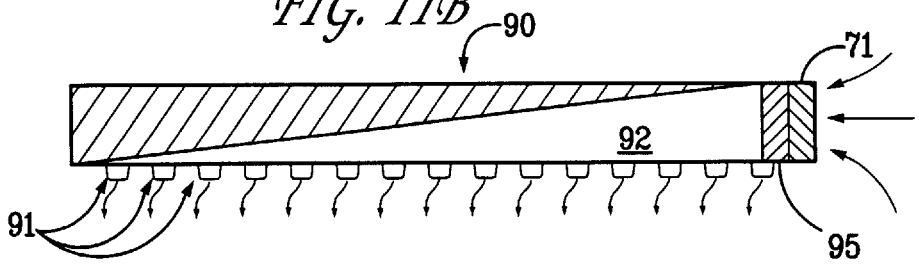
Figure 11C:
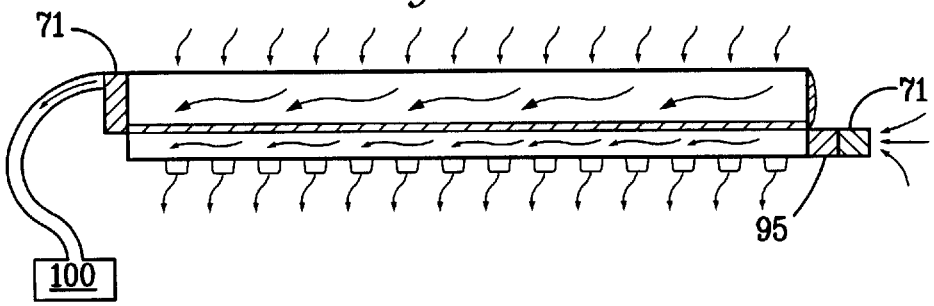
Figure 11D:
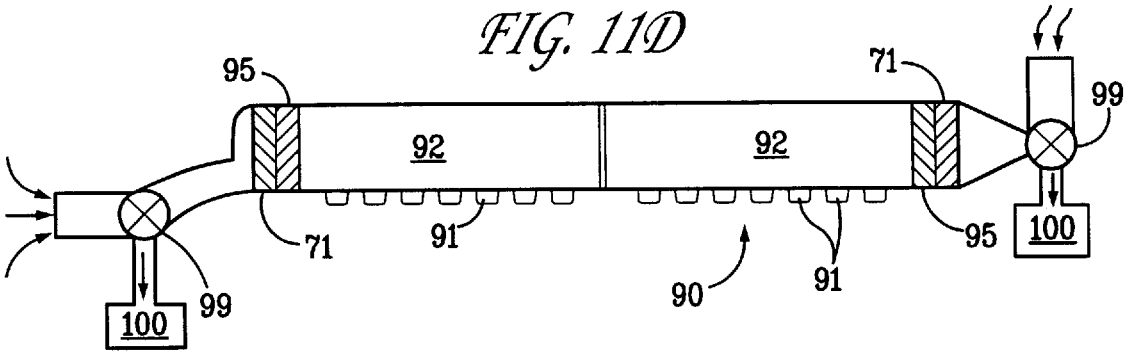

Referring now to FIGS. 11A–D, which depicts a variety of embodiments of the present invention; namely, view A, wherein individual fan and heater sets feed a dual chamber plennum member which is equipped with exit ports adjacent a printing zone of a print engine and a freshly printed section of printing media; view B, wherein a single fan and heater feeds a single chamber plennum designed to produce approximately equal air flow at equally-sized ports or variable-size ports; view C, wherein the plennum member is divided into at least two axially divided chambers with the chamber nearest the printing zone of a print engine fluidly coupled to an evacuating fan in turn fluidly coupled to a vessel; and view D, wherein a the interior compartments of a dual chamber plennum member can switched via valve member to be alternately fed heated air via a heater and fan assembly operating in one direction or evacuated via an exhaust fan. In these embodiments, a reversible fan is best utilized and while existing print engines could be retrofit to operate in the manner disclosed by the embodiments depicted in FIGS. 11A–D, they are presented for purposes of teaching how to appropriately design a large format ink jet print engine capable of dispensing with vapors, particulate matter, and dust so that optimum printing operations are enabled. In the FIGS. 11A–D, wavy arrow indicate direction of air movement, ports 91 are not fully depicted and are intended to vary in location to meet the desired objectives of either evacuating vapors or expelling heated air onto freshly printed output, as the case may be. In FIG. 11A, a dual chamber 92 plenum 90 is designed so that each chamber 92 is supplied by a fan 71 which feeds forced air (arrows) through a heater unit 95 and into each respective chamber 92 and then out of ports 91 onto freshly printed media. In FIG. 11B, a single tapered chamber 92 is supplied by a single fan 71 which feeds air into heater unit 95 and then into the chamber which decreased in interior diameter to promote even air flow out of ports 91 regardless of the distance ports 91 reside from the fan 71. In FIG. 11C, the plenum 90 is separated into two chambers axially and one axial chamber is coupled to a exhaust fan which can be coupled to a vapor capture vessel 100 (or vented to ambient not shown), while a second axial chamber is supplied by a fan 71 which feeds air into a heater unit 95 before the heated air is expelled from the second axial chamber. In FIG. 11D, a dual chamber plenum 90 is arranged much as in FIG. 11A, except that a mechanical valve member 99 coupled to each fan alternately supplies fresh air to the fan 71 which is heated by heater unit 95 and then forced out of ports 91 or air near ports 91 is evacuated into the chamber 92 and through the heater (non-energized at this time) and either is vented to the atmosphere or is directed to a vessel 100 depending on the setting of valve 99. In the embodiment depicted in FIG. 11D, the fan 71 must be able to reverse the direction of fan blade rotation to accomplish the desired air movement as described above.

The following examples are intended to convey a few practical implementations of the present invention in a form that briefly and concisely conveys the salient elements of the invention disclosed, taught, enabled, and disclosed herein. Other forms of the present invention may be readily realized following exposure to the present disclosure, and the following examples are not to inhibit or narrow the full scope and breadth of the invention claimed herein. The full scope and breadth of the present invention shall be only limited by the claims appended hereto, including insubstantial variations and equivalents thereof

EXAMPLE 1

An improved dryer apparatus for drying media printed by a large format ink jet print engine, comprising:

an elongate plennum member having a sealed interior space and oriented to span the lateral width of a large format ink jet print engine and disposed adjacent a printing zone of said large format ink jet print engine;

a plurality of ports formed through a wall of said elongate plennum member, fluidly coupled to the interior space, and oriented proximate the printing zone;

a heating element disposed inside the interior space; and at least one fan means fluidly coupled to said interior space for creating a flow of air over the heating element and through the interior space, and for creating an exhaust flow of heated air though said plurality of ports so that a printing media emerging from said printing zone encounters a heated, chaotic flow of exhaust air which dries a printing ink composition printed onto said printing media.

EXAMPLE 2

An improved dryer apparatus for drying media printed by a large format ink jet print engine, comprising:

an elongate plennum member having a sealed interior space and oriented to span the lateral width of a large format ink jet print engine and disposed adjacent a printing zone of said large format ink jet print engine;

a plurality of overlapping ports formed through a wall of said elongate plennum member, fluidly coupled to the interior space, and oriented proximate the printing zone so that at least two ports contribute to an air flow over every portion of a printing media;

a heating element disposed inside the interior space; and at least one fan fluidly coupled to said interior space for creating an air flow over the heating element into the interior space so that an exhaust flow of heated air is produced at said plurality of ports thereby drying a printing ink composition printed onto said printing media.

EXAMPLE 3

An improved dryer apparatus for drying media printed by a large format ink jet print engine, comprising:

an elongate plennum member having a sealed interior space and oriented to span the lateral width of a large format ink jet print engine and disposed adjacent a printing zone of said large format ink jet print engine;

a plurality of ports formed through a wall of said elongate plennum member, fluidly coupled to the interior space, and oriented proximate the printing zone;

a heating element disposed inside the interior space;

a transitional flow-inducing member fluidly coupled to the elongate plennum member and the heating element and at least one fan means fluidly coupled to said transitional flow-inducing member and then to the interior space for creating a flow of air over the heating element and through the interior space, and for creating an exhaust flow of heated air though said plurality of ports so that a printing media emerging from said printing zone encounters a heated, chaotic flow of exhaust air which dries a printing ink composition printed onto said printing media.

EXAMPLE 4

An improved dryer apparatus for drying media printed by a large format ink jet print engine, comprising:

an elongate plennum member having a sealed interior space and oriented to span the lateral width of a large format ink jet print engine and disposed adjacent a printing zone of said large format ink jet print engine;

a plurality of ports formed through a wall of said elongate plennum member, fluidly coupled to the interior space, and oriented proximate the printing zone;

a heating element disposed inside the interior space wherein said heating element is fabricated of a chromium alloy material and electrically connected to a electrical circuit which includes a high temperature threshold cut-off; and at least one fan means fluidly coupled to said interior space for creating a flow of air over the heating element and through the interior space, and for creating an exhaust flow of heated air though said plurality of ports so that a printing media emerging from said printing zone encounters a heated, chaotic flow of exhaust air which dries a printing ink composition printed onto said printing media.

EXAMPLE 5

An improved dryer apparatus for drying media printed by a large format ink jet print engine, comprising:

an elongate plennum member having a sealed interior space and oriented to span the lateral width of a large format ink jet print engine and disposed adjacent a printing zone of said large format ink jet print engine;

a plurality of ports formed through a wall of said elongate plennum member.

fluidly coupled to the interior space and oriented proximate the printing zone;

a heating element disposed inside the interior space; and at least one fan means fluidly coupled to said interior space for creating a flow of air over the heating element and through the interior space, and for creating an exhaust flow of heated air though said plurality of ports so that a printing media emerging from said printing zone encounters a heated, chaotic flow of exhaust air which dries a printing ink composition printed onto said printing media.

EXAMPLE 6

An improved combination dryer and vapor recovery apparatus for drying media printed by a large format ink jet print engine and capturing vapors emitted during printing operations, comprising:

an elongate plennum member having a sealed interior space and oriented to span the lateral width of a large format link jet print engine and disposed adjacent a printing zone of said large format ink jet print engine;

a plurality of ports formed through a wall, of said elongate plennum member, fluidly coupled to the interior space, and oriented proximate the printing zone a heating element disposed inside the interior space;

at least one fan means fluidly coupled to said interior space for creating a flow of air over the heating element and through the interior space, and for creating an exhaust flow of heated air though said plurality of ports so that a printing media emerging from said printing zone encounters a heated, chaotic flow of exhaust air which dries a printing ink composition printed onto said printing media;

a vapor-receiving means fluidly coupled to the at least one fan means so that when the fan is reversed, air adjacent the plennum member is drawn into said ports, through the plennum member and into said vapor-receiving means; and a valve member for switching the air flow between the exhaust fan drying operation and the vapor recovery operation of the combination dryer and vapor recovery apparatus.

Although that present invention has been described with reference to discrete embodiments, no such limitation is to be read into the claims as they alone define the metes and bounds of the invention disclosed and enabled herein. One of skill in the art will recognize certain insubstantial modifications, minor substitutions, and slight alterations of the apparatus and method claimed herein, that nonetheless embody the spirit and essence of the claimed invention without departing from the scope of the following claims.

What is claimed is:

1. An improved dryer apparatus for drying an ink composition on a printing media in a printer, comprising:

an elongated plenum member having a first end and a second end and an interior space therebetween, the interior space disposable adjacent a printing zone of the printer;

a plurality of ports formed through a wall of said elongated plenum member, fluidly coupled to the interior space, and oriented proximate the printing zone;

a first heating element disposed proximate the first end of the elongated plenum member;

a second heating element disposed proximate the second end of the elongated plenum member;

a first fan and a second fan, both of which are fluidly coupled to said interior space, wherein the first fan is proximate the first end of the elongated plenum member and coupled to the first heating element, and the second fan is proximate the second end of the elongated plenum member and coupled to the second heating element;

wherein the combination of each respective fan/heating element pair creates an exhaust flow of heated air through one or more of said ports for causing a printing media emerging from said printing zone to encounter a flow of heated exhaust air for facilitating the drying of a printing ink composition on a printing media.

2. The apparatus as claimed in claim 1, wherein said elongated plenum member is divided longitudinally into a first and second sealed chambers, wherein the first sealed chamber is provided at one end thereof with one of the fan/heating element pairs and the second sealed chamber is provided at one end thereof with the other fan/heating element pair.

3. The apparatus as claimed in claim 1, wherein the first and second heating elements are positioned inside the interior space.

4. The apparatus as claimed in claim 1, wherein the first heating element is intermediate the first end of the elongated plenum member and the first fan and the second heating element is intermediate the second end of the elongated plenum member and the second fan.

5. The apparatus as claimed in claim 1, wherein the first fan is intermediate the first end of the elongated plenum member and the first heating element and the second fan is intermediate the second end of the elongated plenum member and the second heating element.

6. The apparatus of claim 1, wherein said plurality of ports populate said wall in an overlapping arrangement so that at least two of said plurality of ports expels air onto any given surface portion of said printing media.

7. The apparatus of claim 6, wherein said heating element is chromium wire.

8. The apparatus of claim 7, wherein said elongate plenum member is at least forty inches long.

9. The apparatus of claim 1, wherein at least one of said at least one fan is capable of reverse operation.

10. An improved dryer apparatus for drying ink on a printing media, the dryer apparatus, which is incorporatable into a printer, comprising:

an elongated plenum member axially divided into a drying chamber and an evacuating chamber, wherein the elongated plenum member is positionable adjacent a printing zone of the printer and wherein said drying chamber is the chamber nearest to said printing zone;

a plurality of ports formed through a wall of the drying chamber and oriented proximate the printing zone;

a heating element disposed proximate a first end of the drying chamber and a supply fan coupled to said heating element proximate the first end, wherein the heating element and the supply fan create an exhaust flow of heated air through the plurality of ports so that a media emerging from said printing zone encounters a flow of heated exhaust air which dries an ink composition printed onto the media; and an evacuation fan, positioned at an end of the evacuating chamber, for drawing air out of the evacuating chamber.

11. The dryer apparatus as claimed in claim 10, wherein the heating element is intermediate the first end of the drying chamber and the supply fan.

12. The dryer apparatus as claimed in claim 10, wherein the supply fan is intermediate the first end of the drying chamber and the heating element.

* * * * *